US006707426B2

(12) United States Patent
Shigihara et al.

(10) Patent No.: US 6,707,426 B2
(45) Date of Patent: Mar. 16, 2004

(54) COMPACT, VIBRATION-RESISTANT CIRCULARLY POLARIZED WAVE ANTENNA

(75) Inventors: Makoto Shigihara, Fukushima-ken (JP); Masahiko Higasa, Fukushima-ken (JP)

(73) Assignee: Alps Electric Co., Ltd. (JP)

( * ) Notice: Subject to any disclaimer, the term of this patent is extended or adjusted under 35 U.S.C. 154(b) by 10 days.

(21) Appl. No.: 10/020,428

(22) Filed: Dec. 14, 2001

(65) Prior Publication Data

US 2002/0080075 A1 Jun. 27, 2002

(30) Foreign Application Priority Data

Dec. 15, 2000 (JP) ..... 2000-382689
Sep. 26, 2001 (JP) ..... 2001-294525

(51) Int. Cl.[7] ..... H01Q 1/38
(52) U.S. Cl. ..... 343/700 MS; 343/893
(58) Field of Search ..... 343/700 MS, 702, 343/848, 893, 895

(56) References Cited

U.S. PATENT DOCUMENTS 4,686,536 A * 8/1987 Allcock ..... 343/700 MS
5,471,181 A * 11/1995 Park ..... 333/246
6,111,554 A 8/2000 Chufarovsky et al. ..... 343/895
6,211,751 B1 * 4/2001 Aoki ..... 333/26

FOREIGN PATENT DOCUMENTS

| | | |
|---|---|---|
| EP | 0865100 | 9/1998 |
| EP | 0 896 385 | 2/1999 |
| JP | 2000-077935 | 3/2000 |
| WO | WO 99 17395 | 4/1999 |

* cited by examiner

*Primary Examiner*—Don Wong
*Assistant Examiner*—Shih-Chao Chen
(74) *Attorney, Agent, or Firm*—Brinks Hofer Gilson & Lione

(57) ABSTRACT

In a circularly polarized wave antenna, a dielectric member, which is formed of a dielectric material, such as ceramic, is formed in a quadrilateral columnar shape. A through-hole formed in a quadrilateral shape when viewed from above is provided at the center of the dielectric member. Radiation conductors having the same configuration are formed according to, for example, a printing technique, and are disposed on the corresponding four side surfaces of the dielectric member while being tilted at 45°. In the circularly polarized wave antenna, the dielectric member is fixed on a printed circuit board, and the bottom portions of the radiation conductors are soldered to the corresponding portions of the printed circuit board. With this configuration, mutually in-phase power is supplied to the four radiation conductors.

11 Claims, 14 Drawing Sheets

COMPACT, VIBRATION-RESISTANT CIRCULARLY POLARIZED WAVE ANTENNA

BACKGROUND OF THE INVENTION

1. Field of the Invention

The present invention relates to a circularly polarized wave antenna used for performing communication between a geostationary satellite and a mobile station.

2. Description of the Related Art

In mobile units, such as automobiles, in a system for communicating with a geostationary satellite or receiving broadcasts, circularly polarized waves are generally utilized. Accordingly, there is a demand for a small circularly polarized wave antenna for obtaining stable circularly polarized waves over a wide range of wave angles.

FIGS. 18A and 18B illustrate a typical example of a conventional circularly polarized wave antenna 101. More specifically, FIG. 18A is a perspective view of this antenna, and FIG. 18B is a side view of this antenna. The circularly polarized wave antenna 101 is formed of a ground plate 102 and four conductors 103. Each conductor 103 is formed by extending the central conductor of a coaxial cable 104. The external conductor of the coaxial cable 104 is soldered to the ground plate 102, as indicated by a soldering portion 105. Accordingly, each conductor 103 is fixed on the ground plate 102 in a cantilever form. The conductors 103 are disposed on the ground plate 102 with equal distances d, and tilt in the predetermined directions at a predetermined angle $\alpha$.

In the circularly polarized wave antenna 101 constructed as described above, mutually in-phase power is supplied to the four conductors 103 so as to generate a spatial phase difference of 90°. Accordingly, a main beam is directed at a certain wave angle, and a circularly polarized wave is radiated in the direction of the wave angle. Also, a conical-surface pattern at the wave angle becomes non-directional. That is, the directivity of the circularly polarized wave antenna 101 becomes as shown in FIG. 19 as viewed from any azimuth angle. When a geostationary satellite 107 is positioned at a line extending from an inclined line 106, the circularly polarized wave antenna 101 can always be directed at the geostationary satellite 107 regardless of the direction in which a mobile unit on which the circularly polarized wave antenna 101 is mounted is moved. It is now assumed that the target wave angle ranges from 30° to 60°. In this case, if the tilting angle $\alpha$ of the conductor 103 is set to be about 45°, the length L of the conductor 103 is set to be about $0.65\lambda_0$, and the distance d between the two opposing conductors 103 is set to be about $0.33\lambda_0$ (where $\lambda_0$ indicates the free space wavelength), the optimal directivity for the above-described range of the wave angles can be obtained.

In the above-described conventional circularly polarized wave antenna 101, the four conductors 103 are disposed on the ground plate 102 with the equal distances d while being tilted at about 45°, and mutually in-phase power is supplied to the conductors 103. With this configuration, a phase shifter is not required for supplying power, and thus, the configuration of the circularly polarized wave antenna 101 can be simplified. However, as discussed above, since the four conductors 103 (having a length of approximately $0.65\lambda_0$) are disposed with the equal distances d (approximately $0.33\lambda_0$) at about 45°, the overall dimensions of the antenna 101 result in $0.33\lambda_0 \times 0.33\lambda_0 \times 0.46\lambda_0$. If the frequency of 2.3 GHz ($\lambda_0$=130 mm) is used, the overall dimensions of the antenna 101 increase to 43 mm×43 mm×60 mm. Thus, the antenna 101 is not small enough to be used as a vehicle-mounted antenna. Additionally, since the conductors 103 are fixed to the ground plate 102 only in a cantilever form, they are not mechanically strong. Accordingly, due to vibrations generated in an automobile, the distances d between the conductors 103 may be changed, resulting in increased variations in the characteristics of the antenna 101, or a large stress may be applied to the soldering portions 105 of the external conductors of the coaxial cables 104 so as to cause a poor connection between the coaxial cables 104 and the ground plate 102.

SUMMARY OF THE INVENTION

Accordingly, in view of the above-described background, it is an object of the present invention to provide a compact, vibration-resistant circularly polarized wave antenna.

In order to achieve the above object, according to the present invention, there is provided a circularly polarized wave antenna including a quadrilateral columnar member mounted on a printed circuit board. Four radiation conductors are provided on corresponding side surfaces of the dielectric member while tilting in predetermined directions. The bottom ends of the radiation conductors are electrically connected to the printed circuit board, and mutually in-phase power is supplied to the four radiation conductors.

With this configuration, since the four radiation conductors are provided on the corresponding side surfaces of the quadrilateral columnar dielectric member, the length of the radiation conductors can be decreased due to the wavelength reduction factor as a result of the dielectric constant of the dielectric member. Thus, the size of the circularly polarized wave antenna can be significantly reduced. Additionally, the radiation conductors are mechanically orthogonal to each other by the dielectric member, thereby reducing variations in the characteristics or a poor connection caused by external vibrations.

In the aforementioned circularly polarized wave antenna, a through-hole extending in the axial direction may preferably be provided at the center of the dielectric member. Accordingly, the dielectric member can be lighter, and the axial ratio of circularly polarized waves at a desired frequency can be reduced. In this case, the through-hole may be formed in any shape, such as in a quadrilateral shape or in a circular shape when viewed from above, as long as it is symmetrical with respect to the axial line of the dielectric member. If the through-hole is formed in a quadrilateral shape when viewed from above, dimensional variations in molding the dielectric member can be reduced since the through-hole is similar to the outer configuration of the dielectric member.

In the aforementioned configuration, an adjusting portion may be disposed in the through-hole, and a predetermined resonant frequency may be set by adjusting the size or the mounting position of the adjusting portion. With this arrangement, variations in the antenna characteristics caused by dimensional errors of the dielectric member can be easily corrected. Thus, the resonant frequency can be easily set to a desired frequency, and the manufacturing yield can be substantially improved.

For example, the adjusting portion may be a dielectric block which is inserted into the through-hole and is mounted on the printed circuit board. Then, the resonant frequency of the circularly polarized wave antenna can be increased by decreasing the thickness of the dielectric block. Thus, if the resonant frequency is set to a value slightly lower than the desired frequency in advance, the desired resonant frequency can be easily and reliably obtained simply by decreasing the thickness of the dielectric block to a suitable value. Alternatively, the through-hole may be circular when viewed from above, and a screw thread may be formed on the inner wall surface of the through-hole, and the adjusting portion may be a dielectric male screw to be screwed into the screw thread. In this case, the resonant frequency decreases as the dielectric male screw is inserted into a lower portion of the through-hole. In contrast, the resonant frequency decreases as the dielectric male screw is inserted into a higher portion of the through-hole. Thus, the resonant frequency can be easily and reliably set to the desired frequency only by adjusting the screwing position of the dielectric male screw to a suitable position.

In the aforementioned configuration, the dielectric member may include a columnar hole extending in the axial direction at the center of the bottom of the dielectric member and may also include an adjusting recessed portion at the center of the top of the dielectric member. The predetermined resonant frequency may be set by adjusting the depth of the adjusting recessed portion. In this case, with a deeper adjusting recessed portion, the resonant frequency of the circularly polarized wave antenna becomes greater. Thus, the resonant frequency is set to a value slightly lower than the desired frequency in advance. Then, the desired resonant frequency can be easily and reliably obtained simply by adjusting the depth of the adjusting recessed portion to a suitable value. As a result, the manufacturing yield can be considerably increased.

In the aforementioned configuration, a plurality of through-holes extending parallel to the axial direction of the dielectric member may be provided. With this arrangement, the dielectric member can be lighter, and the axial ratio of the circularly polarized waves at the desired frequency can be decreased. In this case, the plurality of through-holes may be formed in any shape, such as in a quadrilateral shape or in a circular shape when viewed from above, as long as they are provided so that they are positioned symmetrically with respect to the axial line of the dielectric member, and the number of the plurality of through-holes is determined so that they are positioned symmetrically with respect to the axial line of the dielectric member.

DESCRIPTION OF THE PREFERRED EMBODIMENTS

The present invention is described in detail below with reference to the accompanying drawings through illustration of preferred embodiments.

Figure 1:
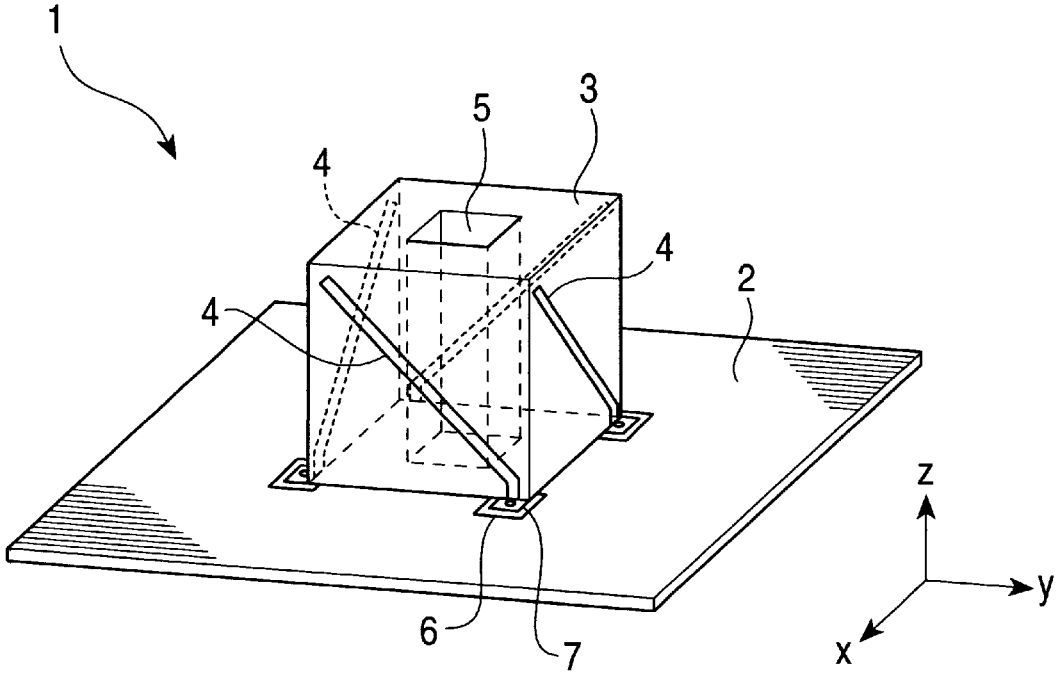
FIG. 1 is a perspective view illustrating a circularly polarized wave antenna according to a first embodiment of the present invention.

FIG. 1 is a perspective view illustrating a circularly polarized wave antenna according to a first embodiment of the present invention.

In FIG. 1, a circularly polarized wave antenna 1 includes a printed circuit board 2, a dielectric member 3, and radiation conductors 4. The dielectric member 3 is formed of a dielectric material, such as ceramic, and is fixed on the printed circuit board 2 with, for example, an adhesive. The dielectric member 3 is formed in a quadrilateral columnar (cubic) shape, and the radiation conductors 4 are formed on the four side surfaces of the dielectric member 3 while being tilted at about 45° by, for example, a printing technique. A through-hole 5 is provided in a quadrilateral shape when viewed from above at the center of the dielectric member 3, and extends in the axial direction of the dielectric member 3.

Figure 2A:
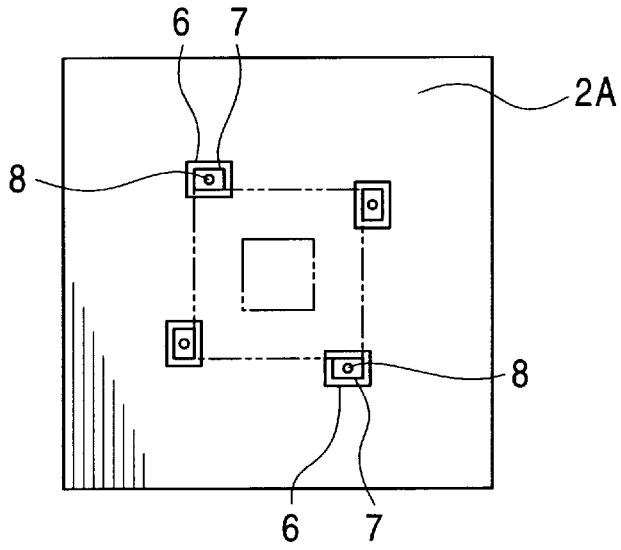
FIGS. 2A and 2B are plan views illustrating an example of the configuration of a printed circuit board for supplying power to the circularly polarized wave antenna shown in FIG. 1.
Figure 2B:
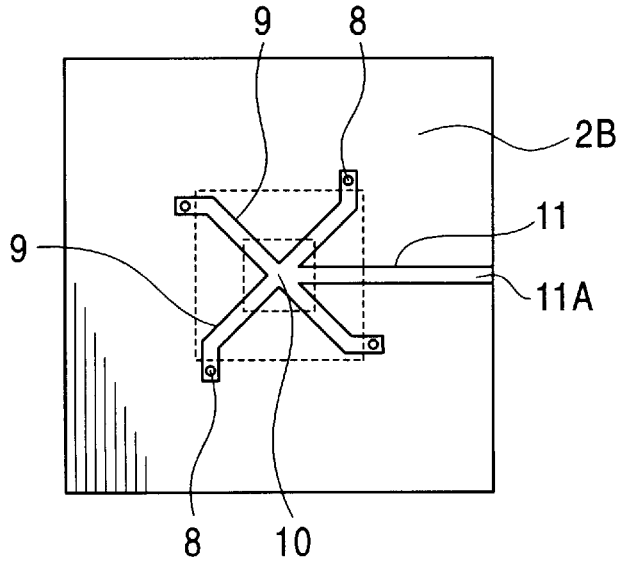

FIGS. 2A and 2B illustrate an example of the printed circuit board 2. More specifically, FIG. 2A illustrates the obverse surface 2A of the printed circuit board 2, and FIG. 2B illustrates the reverse surface 2B of the printed circuit board 2. A ground surface, which is covered with copper foil, is formed on the major part of the obverse surface 2A of the printed circuit board 2. The obverse surface 2A has generally rectangular notches 6 formed therein. A power supply electrode 7 is formed within each notch 6, and is connected to a corresponding microstrip line 9 formed on the reverse surface 2B of the printed circuit board 2 via a through-hole 8. The bottom portion of each radiation conductor 4 of the dielectric member 3 is connected to the power supply electrode 7 on the printed circuit board 2 by, for example, soldering. As discussed above, the microstrip lines 9 are formed on the reverse surface 2B of the printed circuit board 2 and contain the through-holes 8 therein. The four microstrip lines 9 are configured so that the distances between the through-holes 8 and an intersection 10 of the microstrip lines 9 become equal to each other. Another microstrip line 11 is extended from the intersection 10, and is connected to a radio frequency (RF) amplifier (not shown) at an end 11A of the microstrip line 11. According to the above-configured circularly polarized wave antenna 1, mutually in-phase power is supplied to each of the radiation conductors 4.

In the circularly polarized wave antenna 1, as well as in the counterpart of the related art, the distance between the two opposing radiation conductors 4 and the length of the radiation conductor 4 must be set to suitable values to obtain an optimal directivity. When the wavelength of the radio waves on the dielectric member 3 is indicated by $\lambda e1$, the length L1 of the radiation conductor 4 results in $0.65 \cdot \lambda e1$. When the length of one side of the dielectric member 3 is represented by L2, L2 requires a length of at least $L1/\sqrt{2}$ since the radiation conductor 4 tilts at about 45°. Then, the distance d1 between the two opposing radiation conductors 4 is equal to the length L2 of one side of the dielectric member 3. Accordingly, the mechanical dimension of the distance d1 can be automatically determined to be $L1/\sqrt{2}$. However, when the wavelength of the radio waves in the dielectric member 3 is set to be $\lambda e2$, the distance d1 has to satisfy a relationship expressed by $d1=0.33 \cdot \lambda e2$. In this case, since the dielectric member 3 has the hollow through-hole 5 therein, the relationship expressed by $\lambda e2>\lambda e1$ holds true due to an air space (having a relative dielectric constant of 1) within the through-hole 5. Accordingly, by setting the through-hole 5 to a suitable size, the relationship expressed by $d1=L1/\sqrt{2}=0.33 \cdot \lambda e2$ can be satisfied.

Figure 3:
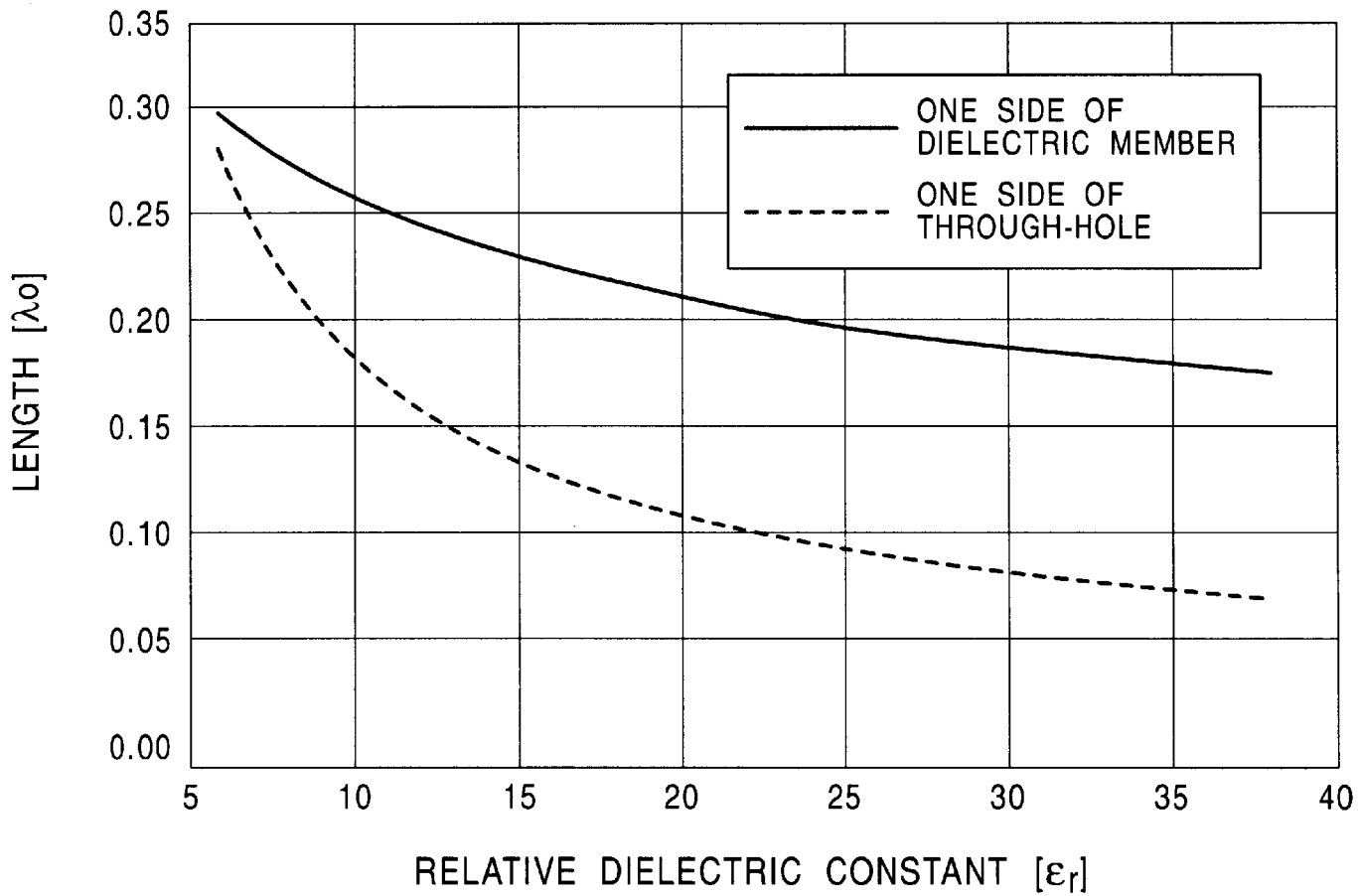
FIG. 3 is a diagram illustrating the relationship between the relative dielectric constant and the length of one side of a dielectric member and that of a through-hole used in the circularly polarized wave antenna shown in FIG. 1.

FIG. 3 illustrates the relationship between the relative dielectric constant and the length of one side of the dielectric member 3 and that of the through-hole 5. In FIG. 3, the horizontal axis represents the relative dielectric constant $\in_r$ of the dielectric member 3, and the vertical axis designates the lengths obtained by normalizing one side of the dielectric member 3 and one side of the through-hole 5 by the free-space wavelength $\lambda_0$. For example, when the relative dielectric constant $\in_r$ of the dielectric member 3 is 35, the length of one side of the dielectric member 3 is about $0.18\lambda_0$, and the overall dimensions of the circularly polarized wave antenna 1 result in approximately $0.18\lambda_0 \times 0.18\lambda_0 \times 0.18\lambda_0$. Accordingly, with the use of a frequency of 2.3 GHz ($\lambda$=130 mm), as in the known antenna 101, the overall dimensions of the circularly polarized wave antenna 1 result in approximately 23 mm×23 mm×23 mm. Consequently, the size of the circularly polarized wave antenna 1 can be significantly reduced.

Figure 18A:
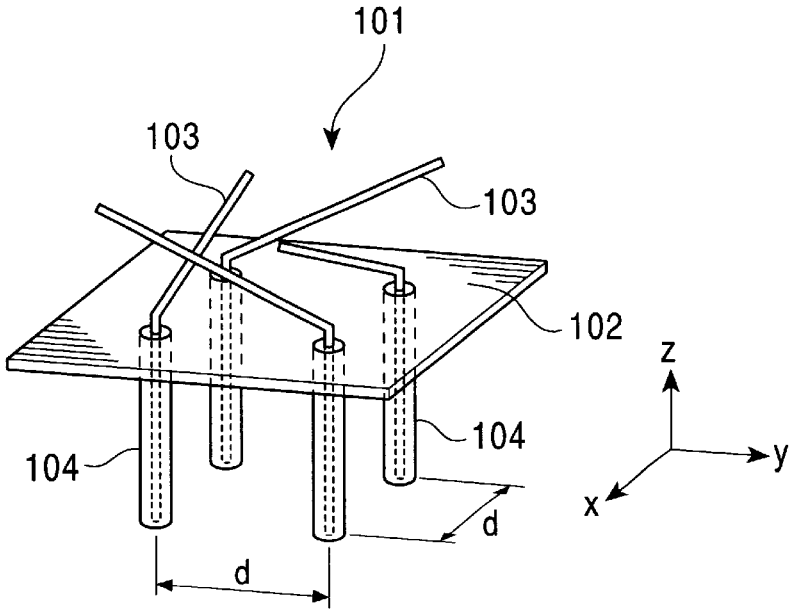
FIG. 18A PRIOR ART
FIGS. 18A and 18B illustrate an example of a known circularly polarized wave antenna.
Figure 18B:
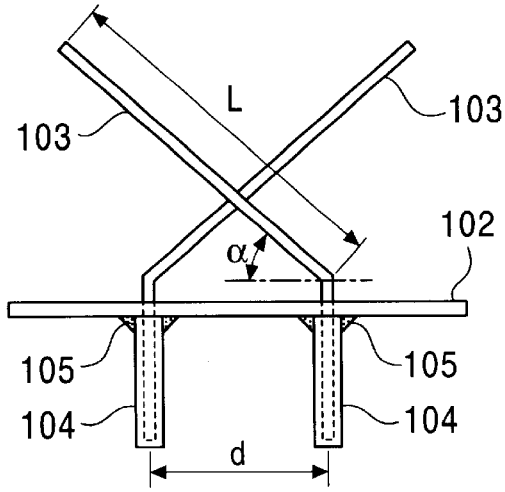
FIG. 18B PRIOR ART
Figure 19:
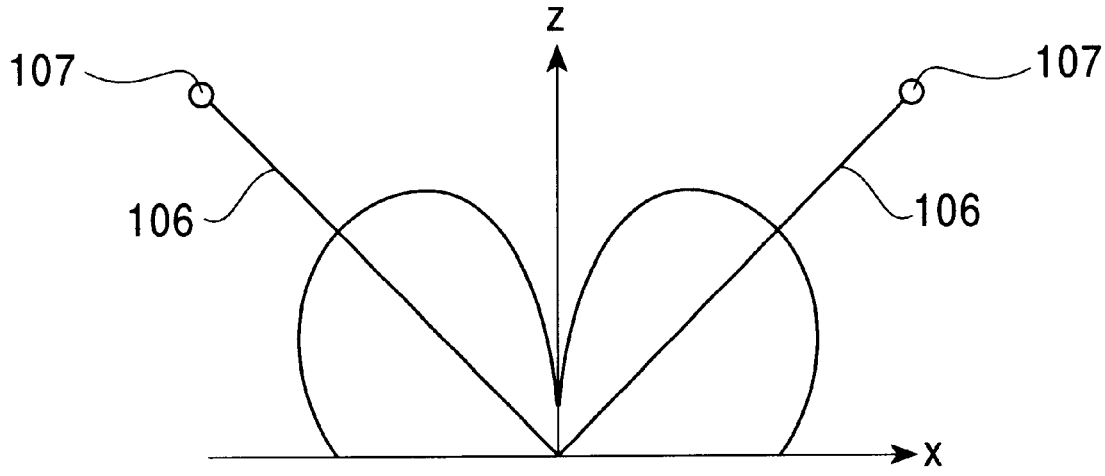
FIG. 19 PRIOR ART
FIG. 19 illustrates the directivity of a circularly polarized wave antenna.

The operation of the circularly polarized wave antenna 1 according to the first embodiment of the present invention is basically similar to that of the known antenna 101 shown in FIGS. 18A and 18B. More specifically, the two radiation conductors 4 generating polarized waves which are spatially orthogonal to each other are disposed with a distance therebetween so that a phase difference of 90° can be generated, and then, they are driven at equal amplitudes, thereby obtaining circularly polarized waves. Two pairs of the above-described radiation conductors 4 (a total of four conductors) are disposed to be orthogonal to each other. As a result, circularly polarized waves which are uniform in the entire azimuth direction can be obtained. In the circularly polarized wave antenna 1, since the radiation conductor 4 is disposed on each side surface of the dielectric member 3 formed in a quadrilateral columnar shape, the required length of the radiation conductor 4 is decreased due to the wavelength reduction factor as a result of the wavelength due to the dielectric constant of the dielectric member 3. Thus, the size of the antenna 1 can be significantly reduced. Additionally, a mechanically orthogonal relationship of the radiation conductors 4 can be maintained by the dielectric member 3, thereby reducing variations in the characteristics or a poor connection caused by external vibrations. Because of the provision of the through-hole 5 extending in the axial direction at the center of the dielectric member 3, the dielectric member 3 can be lighter, and the axial ratio of the circularly polarized waves at a desired frequency can be decreased. Moreover, the through-hole 5, which is formed in a quadrilateral shape when viewed from above, is similar to the outer configuration of the dielectric member 3, thereby reducing dimensional variations when molding the dielectric member 3.

Figure 4:
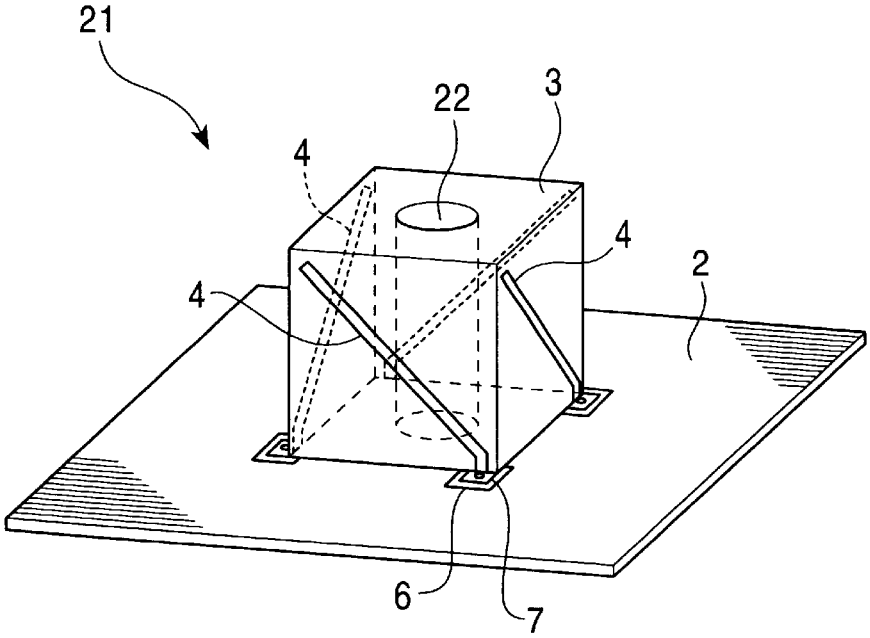
FIG. 4 is a perspective view illustrating a circularly polarized wave antenna according to a second embodiment of the present invention.

FIG. 4 is a perspective view illustrating a circularly polarized wave antenna 21 according to a second embodiment of the present invention. In FIG. 4, the same elements as those of the circularly polarized wave antenna 1 of the first embodiment are indicated by like reference numerals, and an explanation thereof will thus be omitted. The main feature of the circularly polarized wave antenna 21 of the second embodiment is that a through-hole 22 formed in a circular shape when viewed from above is provided. The through-hole 22 extends in the axial direction at the center of the dielectric member 3. Since the through-hole 22 is formed in a circular shape, the fitting of a mold for molding the dielectric member 3 becomes simpler, thereby exhibiting good molding characteristics. The quality of the mold can also be maintained.

Figure 5:
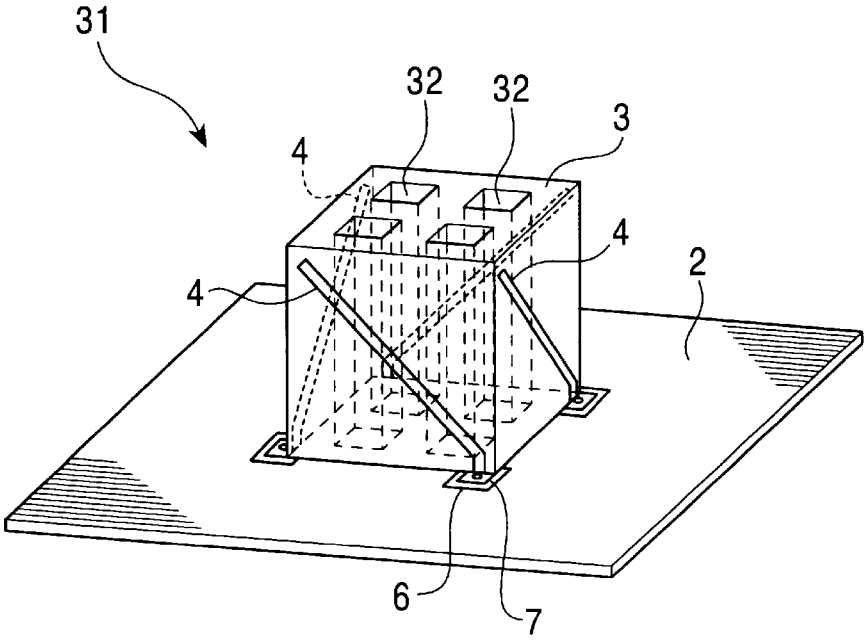
FIG. 5 is a perspective view illustrating a circularly polarized wave antenna according to a third embodiment of the present invention.

FIG. 5 is a perspective view illustrating a circularly polarized wave antenna 31 according to a third embodiment of the present invention. In FIG. 5, the same elements as those of the circularly polarized wave antenna 1 of the first embodiment are indicated by like reference numerals, and an explanation thereof will thus be omitted. The main feature of the circularly polarized wave antenna 31 is that a plurality of through-holes 32 formed in a quadrilateral shape when viewed from above are provided. The through-holes 32 are extended parallel to the axial direction of the dielectric member 3. Because of the provision of a plurality of the through-holes 32, even if there is a variation in the dimensional precision of the individual through-holes 32 required for implementing the above-described equivalent relative dielectric constant $\lambda e2$, the overall influence of such a variation can be minimized.

Figure 6:
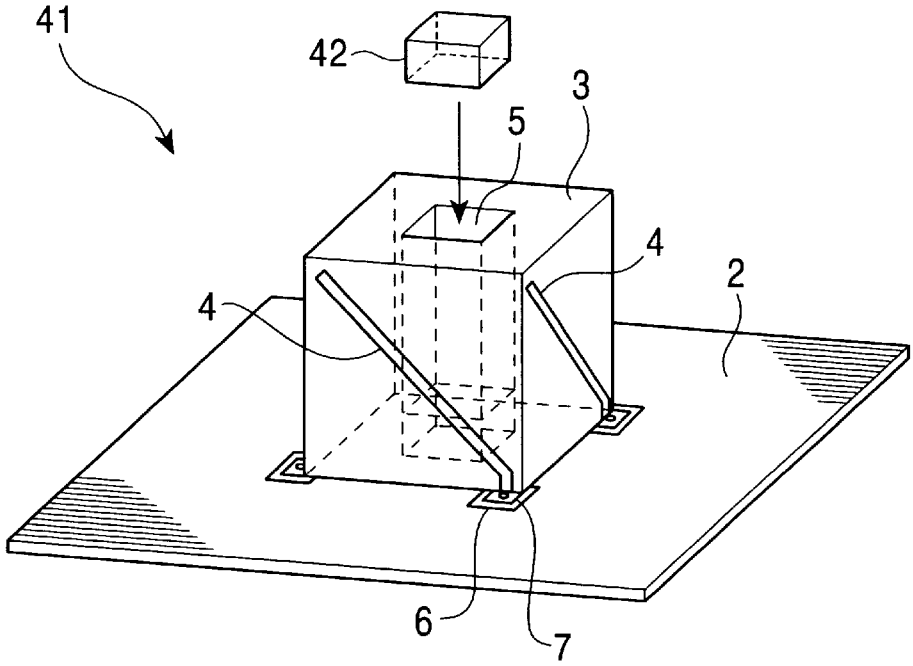
FIG. 6 is a perspective view illustrating a circularly polarized wave antenna according to a fourth embodiment of the present invention.
Figure 7:
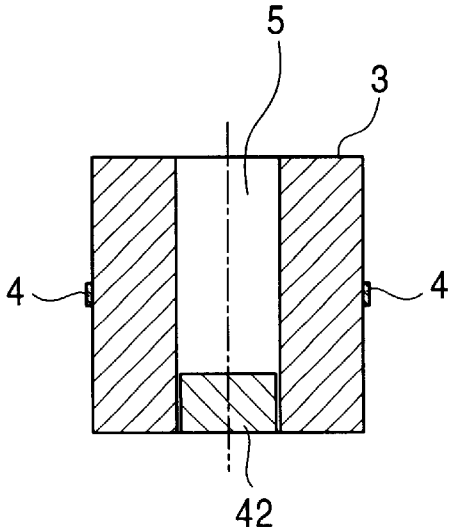
FIG. 7 is a sectional view illustrating the essential portion of the circularly polarized wave antenna shown in FIG. 6.

FIG. 6 is a perspective view illustrating a circularly polarized wave antenna 41 according to a fourth embodiment of the present invention, and FIG. 7 is a sectional view illustrating the essential portion of the circularly polarized wave antenna 41 shown in FIG. 6. In FIGS. 6 and 7, the same elements as those of the first embodiment are designated with like reference numerals, and an explanation thereof will thus be omitted. The main feature of the circularly polarized wave antenna 41 shown in FIG. 6 is that a dielectric block 42, which serves as an adjusting portion, is inserted into the through-hole 5 formed in a square shape when viewed from above at the center of the dielectric member 3. By providing the dielectric block 42, a desired resonant frequency of the circularly polarized wave antenna 41 can be obtained. As in the dielectric member 3, the dielectric block 42 is formed of a dielectric material, such as ceramic, and is fixed at the bottom of the printed circuit board 2 with, for example, an adhesive.

Figure 8:
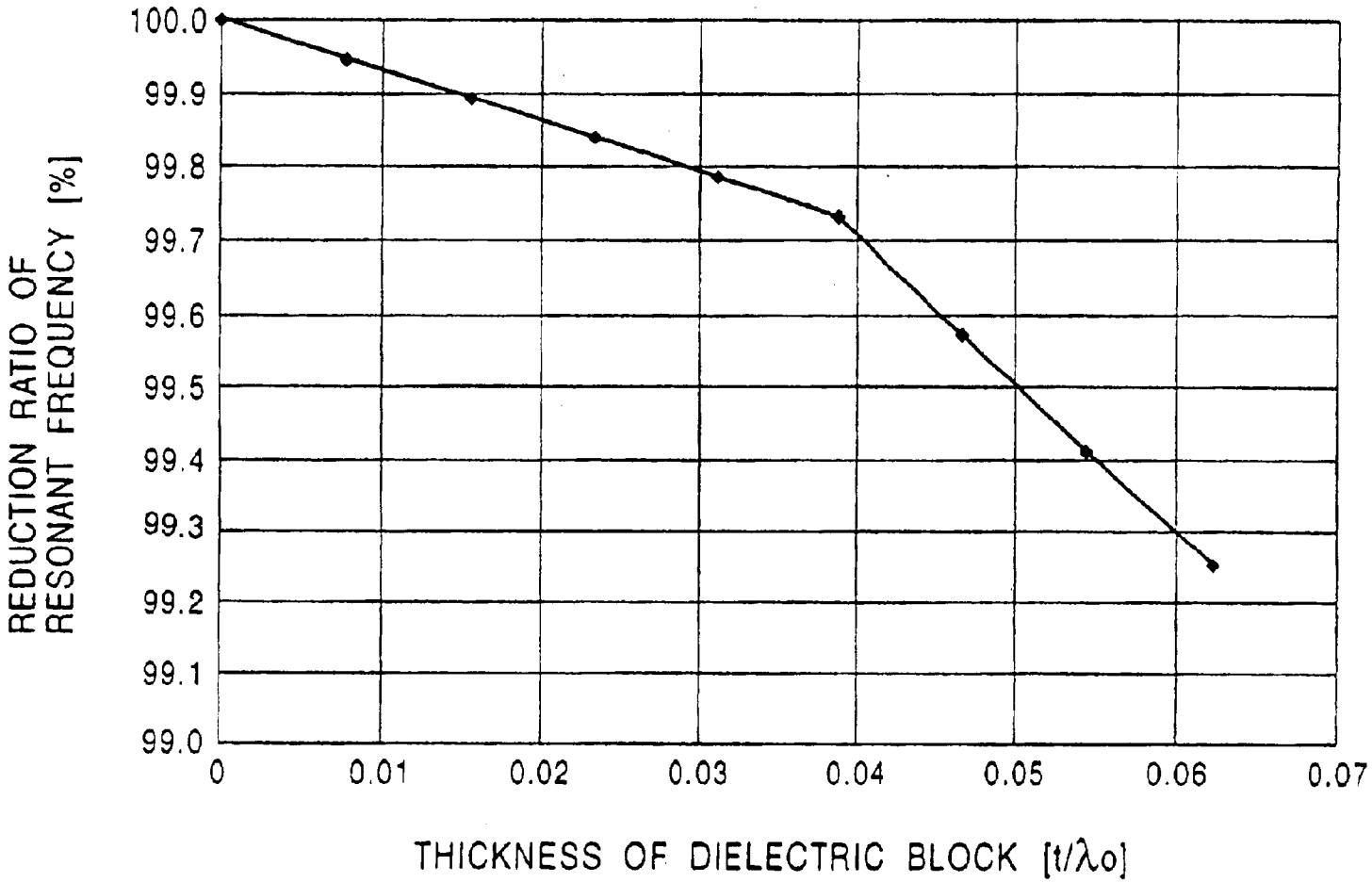
FIG. 8 is a diagram illustrating the relationship between the thickness of a dielectric block used in the circularly polarized wave antenna shown in FIG. 6 and the resonant frequency.

In the above-configured circularly polarized wave antenna 41, any variation in the dimensions or in the dielectric constant of the dielectric member 3 can be absorbed by suitably adjusting the thickness of the dielectric block 42 disposed in the through-hole 5. Thus, the resonant frequency of the circularly polarized wave antenna 41 can easily be set to a desired frequency. For example, when the relative dielectric constant of the dielectric member 3 or the dielectric block 42 is 35, and the frequency is in the S band, as shown in FIG. 8, the resonant frequency of the circularly polarized wave antenna 41 is changed according to the thickness t of the dielectric block 42. In FIG. 8, the horizontal axis designates the thickness of the dielectric block 42 normalized by the free space wavelength $\lambda_0$ of the radio waves, and the vertical axis indicates the reduction ratio of the resonant frequency of the dielectric member 3 compared to that of a dielectric member without the dielectric block 42 in the through-hole 5. In FIG. 8, when the thickness t of the dielectric block 42 ranges approximately from $0.04\lambda_0$ to $0.06\lambda_0$, i.e., when 5 mm<t<8 mm, where $\lambda_0$ is 130 mm, the resonant frequency is increased by about 0.2% as the thickness t is decreased by $0.01\lambda_0$. Accordingly, the resonant frequency is set to a value slightly lower than the desired frequency in advance. Then, the resonant frequency can be easily and reliably set to the desired frequency merely by decreasing the thickness t of the dielectric block 42 to a suitable value, and the axial ratio characteristics can also be improved. Thus, the yield during mass production is significantly improved, and accordingly, the manufacturing cost is considerably decreased.

In this embodiment, the through-hole 5 and the dielectric block 42 are formed in a square shape when viewed from above. However, when they are used in the dielectric member 3 having the circular through-hole 22 when viewed from above, such as in the circularly polarized wave antenna 21 of the second embodiment, the dielectric block 42 may be formed in a circular shape when viewed from above.

Figure 9:
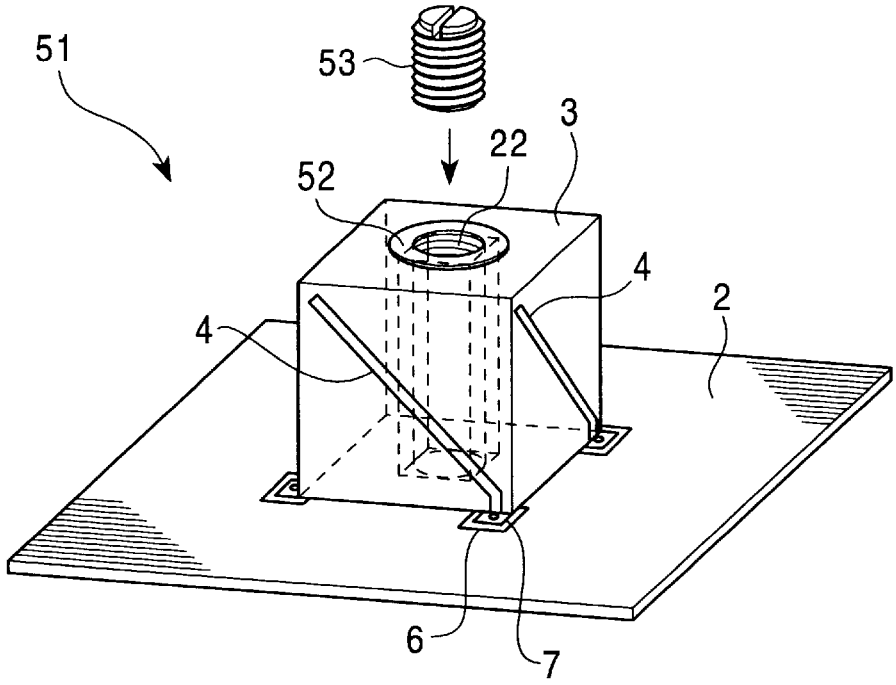
FIG. 9 is a perspective view illustrating a circularly polarized wave antenna according to a fifth embodiment of the present invention.
Figure 10:
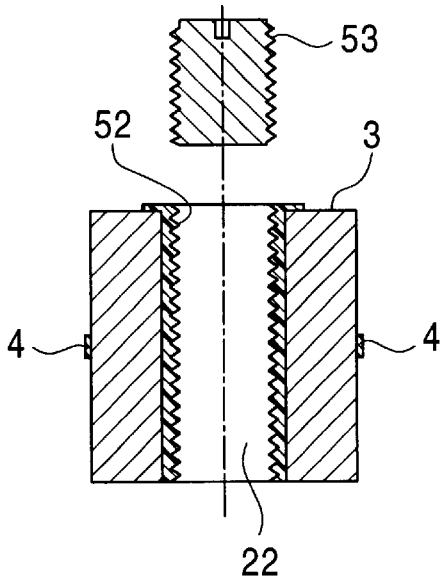
FIG. 10 is a sectional view illustrating the essential portion of the circularly polarized wave antenna shown in FIG. 9.

FIG. 9 is a perspective view illustrating a circularly polarized wave antenna 51 according to a fifth embodiment of the present invention. FIG. 10 is a sectional view illustrating the essential portion of the circularly polarized wave antenna 51 shown in FIG. 9. In FIGS. 9 and 10, the same elements as those of the second embodiment shown in FIG. 4 are designated with like reference numerals, and an explanation thereof will thus be omitted. The main feature of the circularly polarized wave antenna 51 is that a female thread 52 formed of a synthetic resin is fixed on the inner wall surface of the circular through-hole 22 provided at the center of the dielectric member 3, and that a male thread 53, which serves as an adjusting portion, is screwed into the female thread 52. As in the dielectric member 3, the male thread 53 is formed of a dielectric material, such as ceramic. The male thread 53 is partially inserted into the through-hole 22 by a predetermined amount while being screwed into the female thread 52.

In the above-configured circularly polarized wave antenna 51, the resonant frequency of the circularly polarized wave antenna 51 varies according to the fixing position (screwing position) of the male thread 53. The reduction ratio of the resonant frequency becomes smaller as the male thread 53 is inserted into a lower portion of the through-hole 22, and the reduction ratio of the resonant frequency becomes larger as the male thread 53 is inserted into an upper portion of the through-hole 22. Accordingly, the resonant frequency of the circularly polarized wave antenna 51 can be set easily and reliably to a desired frequency simply by adjusting the screwing position of the male thread 53 in the through-hole 22. As a result, the manufacturing yield can be substantially improved. If the screwing position of the male thread 53 in the through-hole 22 is adjusted during the manufacturing process, the male thread 53 is preferably fixed to the female thread 52 with, for example, an adhesive. Then, the resonant frequency obtained after adjusting the screwing position can be maintained.

Figure 11:
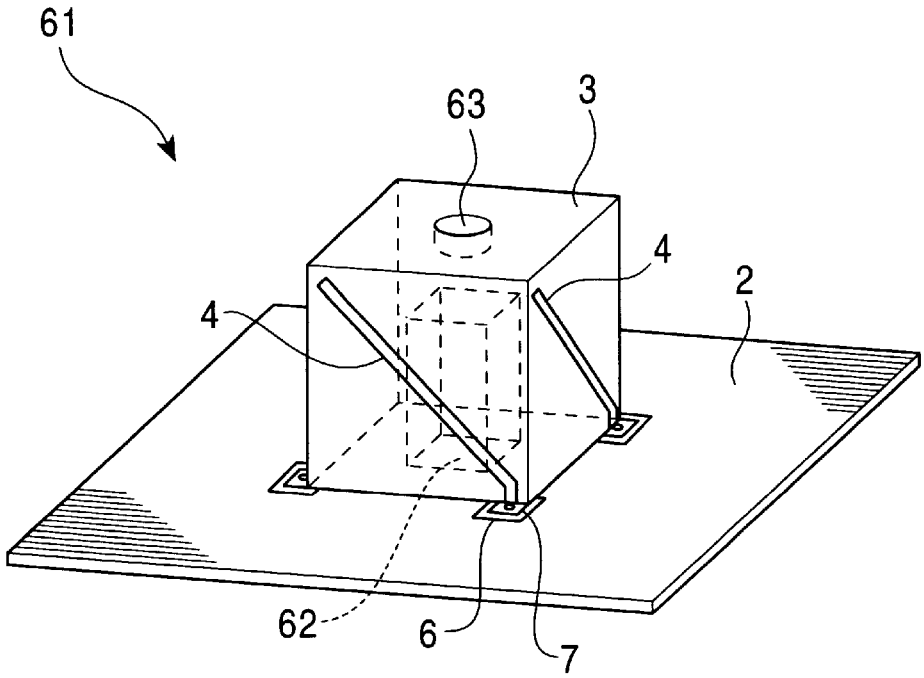
FIG. 11 is a perspective view illustrating a circularly polarized wave antenna according to a sixth embodiment of the present invention.
Figure 12:
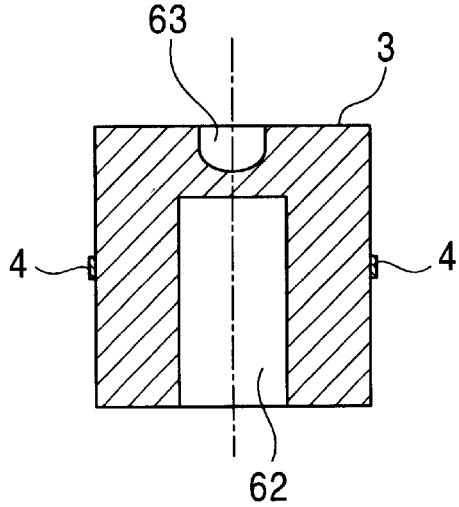
FIG. 12 is a sectional view illustrating the essential portion of the circularly polarized wave antenna shown in FIG. 11.

FIG. 11 is a perspective view illustrating a circularly polarized wave antenna 61 according to a sixth embodiment of the present invention. FIG. 12 is a sectional view illustrating the essential portion of the circularly polarized wave antenna 61 shown in FIG. 11. In FIGS. 11 and 12, the same elements as those of the first embodiment are indicated by like reference numerals, and an explanation thereof will thus be omitted. The main feature of the circularly polarized wave antenna 61 is that the dielectric member 3 formed in a quadrilateral columnar shape has a columnar hole 62 extending in the axial direction at the center of the bottom surface of the dielectric member 3, and also has an adjusting recessed portion 63 at the center of the top surface of the dielectric member 3.

In the above-configured circularly polarized wave antenna 61, by suitably adjusting the depth of the adjusting recessed portion 63 provided at the center of the top surface of the dielectric member 3, the resonant frequency of the circularly polarized wave antenna 61 can be modified. More specifically, with a deeper adjusting recessed portion 63, the resonant frequency of the circularly polarized wave antenna 61 becomes greater. Thus, the resonant frequency is set to a value slightly lower than the desired frequency in advance. Then, the desired resonant frequency can be easily and reliably obtained merely by increasing the depth of the adjusting recessed portion 63 to a suitable value. As a result, the manufacturing yield can be substantially increased. In this embodiment, unlike the fifth embodiment, it is not necessary to insert the dielectric block 42 and a dielectric adjusting portion, such as the male thread 53, into the dielectric member 3, the number of parts can be reduced.

Figure 13:
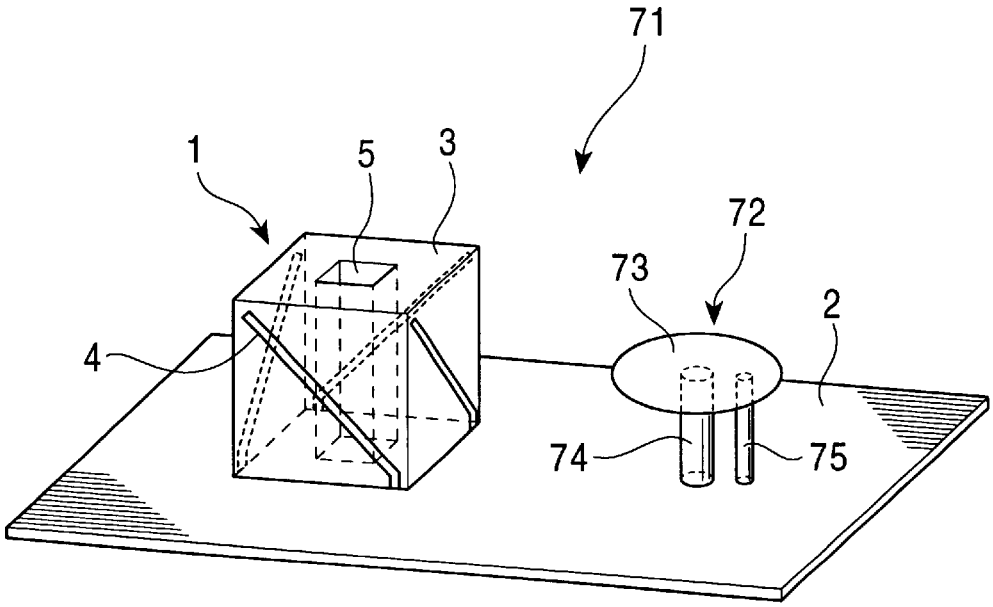
FIG. 13 is a perspective view illustrating a composite antenna according to an embodiment of the present invention.

FIG. 13 is a perspective view illustrating a composite antenna 71 applied to a satellite broadcast system using a geostationary satellite. In this composite antenna 71, the circularly polarized wave antenna 1 and a TM01-mode circular patch antenna 72 are mounted on the printed circuit board 2. The composite antenna 71 is particularly effective for use in a satellite broadcast system for re-transmitting content similar to direct broadcast waves transmitted from the geostationary satellite so as to increase the reception probability in dead zones, such as behind buildings. The circularly polarized wave antenna 1, which is configured similarly to that shown in FIG. 1, receives circularly polarized waves, which are satellite waves. The circular patch antenna 72 receives vertically polarized waves, which are terrestrial waves. The center of a disk 73 is grounded by a ground conductor 74, and power is supplied to the circular patch antenna 72 at a position offset by a power supply pin 75. Alternatively, the offset position may be grounded and the power may be supplied to the center of the disk 73. In either case, the circular patch antenna 72 has a radiation field similar to a monopole antenna, and is thus suitable for use as a thin vertically polarized wave antenna mounted in a vehicle. The resonant frequency of the circular patch antenna 72 is determined by three factors, such as the outer diameter of the disk 73, the inner diameter of the disk 73, i.e., the grounding portion of the disk 73, and the height of the disk 73. Thus, there is a great flexibility in designing the circular patch antenna 72. It is therefore possible to flexibly respond to the characteristics and the dimensions required for a composite antenna. Accordingly, in the composite antenna 71 formed by a combination of the above-described circularly polarized wave antenna 1 and the circular patch antenna 72, the overall dimensions including the printed circuit board 2 result in about $0.65\lambda_0 \times 0.25\lambda_0 \times 0.2\lambda_0$. Thus, a small and thin composite antenna suitable for use in a vehicle can be implemented. In this embodiment, as the circularly polarized wave antenna, the antenna 1 shown in FIG. 1 is used. However, any one of the circularly polarized wave antennas 21, 31, 41, 51, and 61 shown in FIGS. 4 through 7 and 9 through 12 may be used to implement a similar composite antenna.

Figure 14:
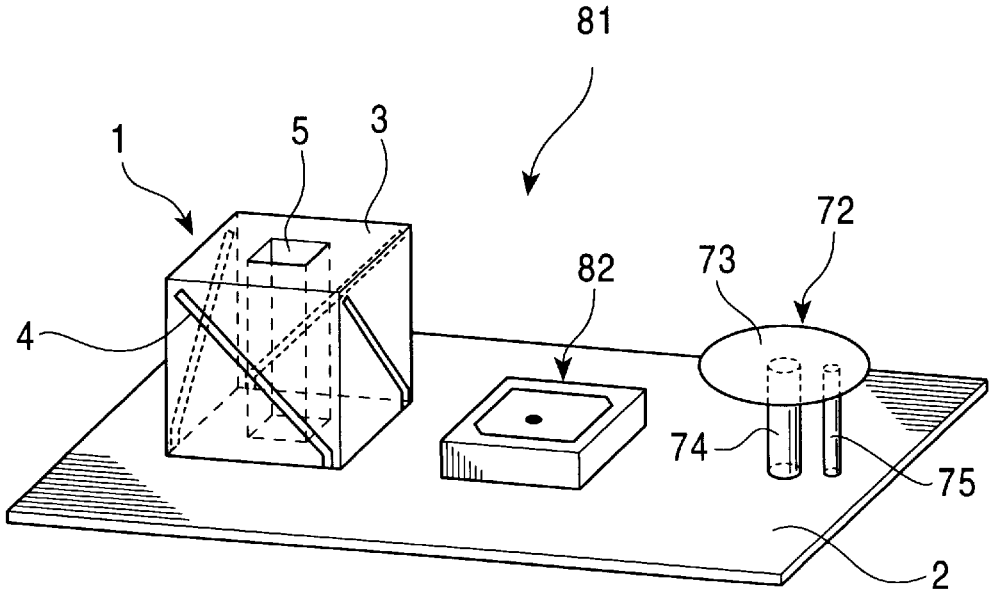
FIG. 14 is a perspective view illustrating a composite antenna according to an embodiment of the present invention.

FIG. 14 is a perspective view illustrating a composite antenna 81 applied to a system incorporating the above-described satellite broadcast system and the global positioning system (GPS). The circularly polarized wave antenna 1, the TM01-mode circular patch antenna 72, and a GPS antenna 82 are mounted on the printed circuit board 2. Among the three antennas, the circularly polarized wave antenna 1 and the circular patch antenna 72 are configured similarly to those shown in FIG. 13. The circularly polarized wave antenna 1 receives circularly polarized waves, which are satellite waves, while the circular patch antenna 72 receives vertically polarized waves, which are terrestrial waves. The distance between the center of the circularly polarized wave antenna 1 and that of the circular patch antenna 72 is set to $0.5\lambda_0$ to $1.0\lambda_0$. The GPS antenna 82, which is formed of a dielectric material, such as ceramic, is disposed between the circularly polarized wave antenna 1 and the circular patch antenna 72. With this configuration, the crosstalk between the satellite broadcast system antenna device (circularly polarized wave antenna 1) and the terrestrial wave system antenna device (circular patch antenna 72) can be decreased. Simultaneously, the GPS antenna 82 having a different frequency band can be disposed. Thus, a small and thin composite antenna suitable for use in a vehicle can be implemented. In this embodiment, as the circularly polarized wave antenna, the antenna 1 shown in FIG. 1 is used. However, any one of the circularly polarized wave antennas 21, 31, 41, 51, and 61 shown in FIGS. 4 through 7 and 9 through 12 may be used to implement a similar composite antenna.

Figure 15:
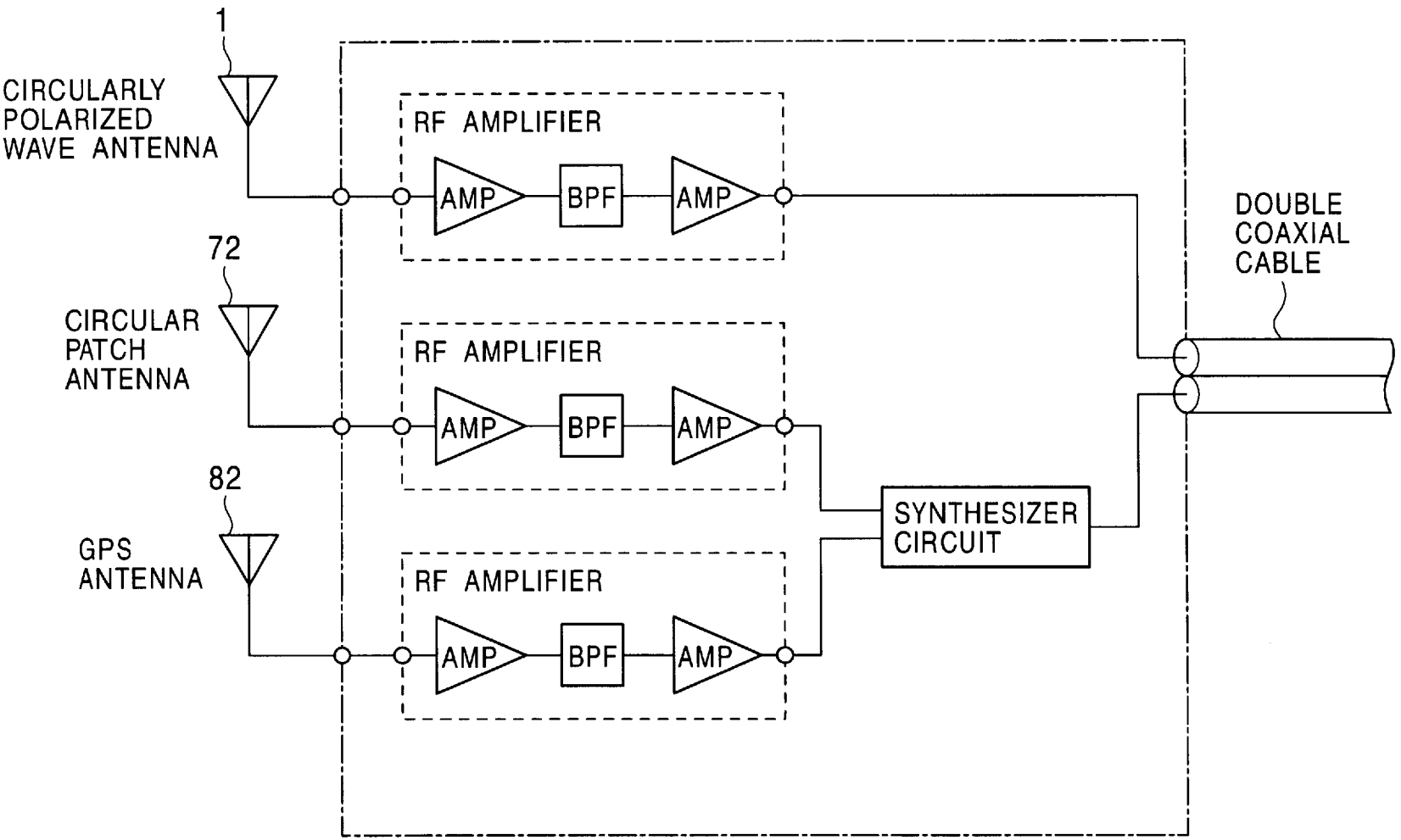
FIG. 15 is a circuit diagram illustrating the composite antenna shown in FIG. 14.
Figure 16:
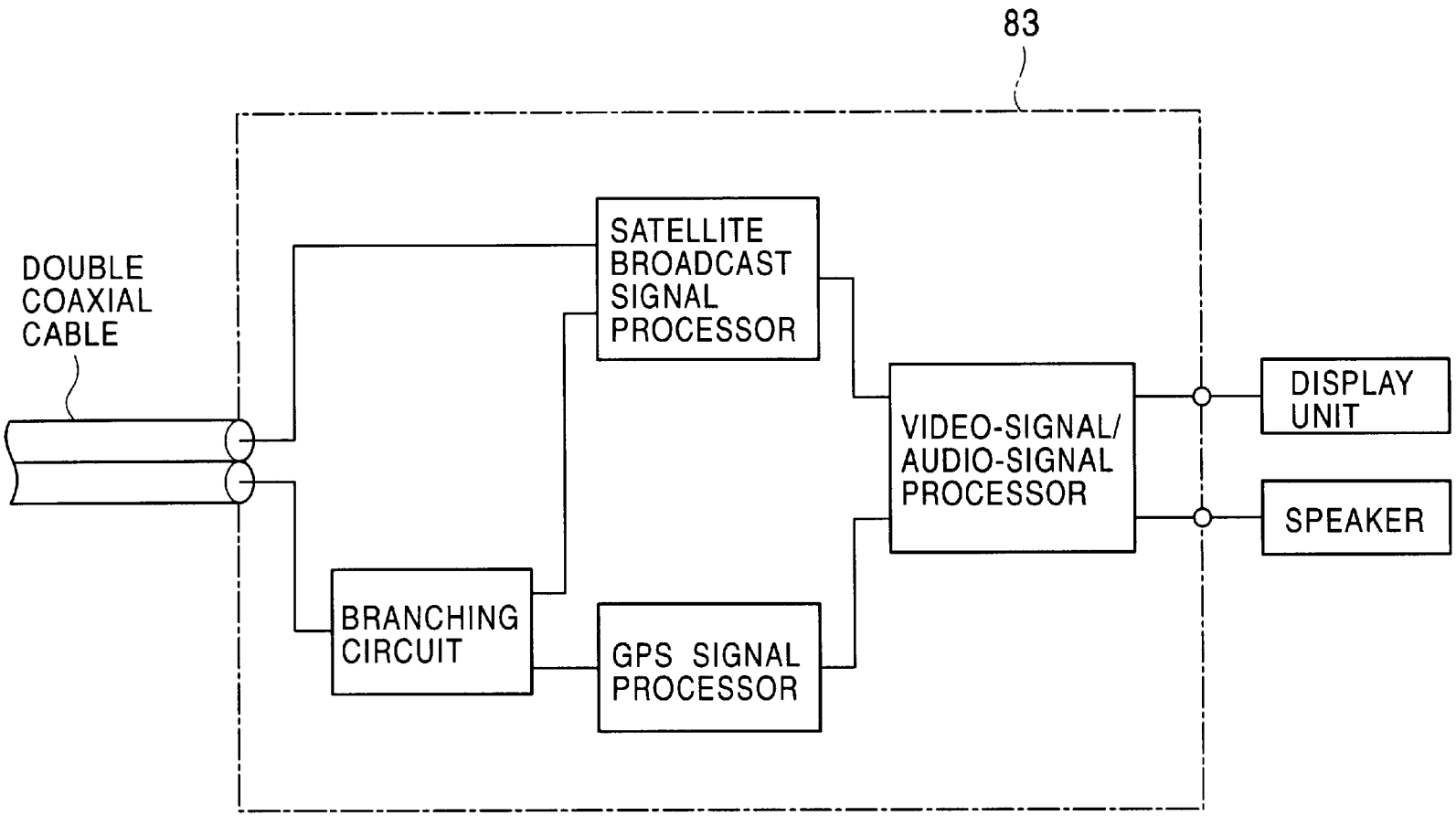
FIG. 16 is a block diagram illustrating a receiving device used in the composite antenna shown in FIG. 14.

FIG. 15 is a circuit diagram illustrating the composite antenna 81 shown in FIG. 14. FIG. 16 is a block diagram illustrating a receiving device for use in the composite antenna 81. As shown in FIGS. 15 and 16, a satellite wave received by the circularly polarized wave antenna 1 is amplified to a predetermined level by a radio frequency (RF) amplifier, and is then transmitted to a receiving device 83 from one of the cables of a double coaxial cable. Meanwhile, terrestrial waves received by the circular patch antenna 72 and radio waves received by the GPS antenna 82 are amplified to predetermined levels by the corresponding RF amplifiers, and are then transmitted to the receiving device 83 from the other cable of the double coaxial cable via a synthesizer circuit. In the receiving device 83, the satellite RF signal transmitted from one cable of the double coaxial cable and the terrestrial RF signal transmitted from the other cable via a branching circuit are supplied to a satellite broadcast signal processor. The satellite broadcast signal processor processes the RF signals, and supplies them to a video-signal/audio-signal processor. Then, the video-signal/audio-signal processor processes the RF signals into a video signal and an audio signal obtained from the satellite RF signals, and output them to a display unit and a speaker of a car navigation system. Thus, broadcast information transmitted from the geostationary satellite is output from the display unit and the speaker. The GPS RF signal is supplied to a GPS signal processor via the branching circuit. Then, the GPS signal processor processes the GPS RF signal and supplies it to the video-signal/audio-signal processor. The video-signal/audio-signal processor processes a video signal and an audio signal obtained from the GPS RF signal, and outputs them to the display unit and the speaker, respectively, of the car navigation system. Thus, automobile positional information transmitted from the geostationary satellite is output from the display unit and the speaker. The circuit configuration shown in the circuit diagrams shown in FIGS. 15 and 16 are only an example of the composite antenna 81, and another circuit configuration may be employed.

Figure 17:
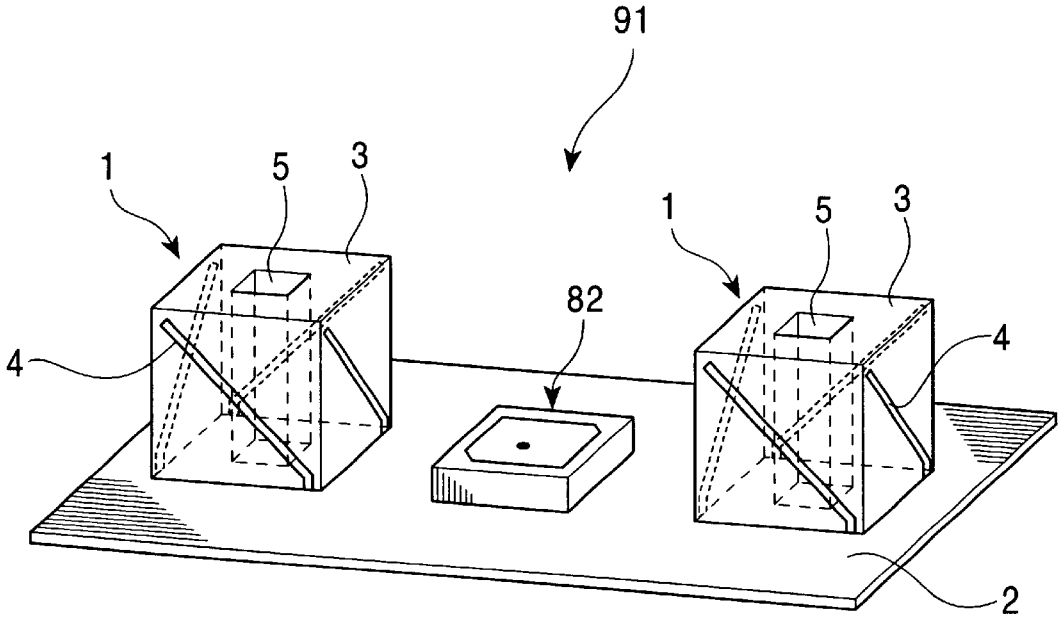
FIG. 17 is a perspective view illustrating a composite antenna, which is a modification made to the composite antenna shown in FIG. 14.

FIG. 17 is a perspective view illustrating a composite antenna 91, which is a modification made to the composite antenna 81 shown in FIG. 14. In the composite antenna 91, the two circularly polarized wave antennas 1 and the GPS antenna 82 are mounted on the printed circuit board 2. The circularly polarized wave antenna 1 is constructed similarly to that shown in FIG. 1. The distance between the center of one of the circularly polarized wave antennas 1 and that of the other antenna 1 is $0.5\lambda_0$ to $1.0\lambda_0$. The GPS antenna 82 is disposed between the two circularly polarized wave antennas 1. This system is effective in a satellite broadcast system which is provided with only one broadcast satellite so as to implement diversity reception. The above-configured circularly polarized wave antenna 1 has a directivity suitable for receiving terrestrial waves as well as satellite waves. Thus, in this embodiment, unlike the embodiment shown in FIG. 14, an antenna device for re-transmitting terrestrial waves is not provided for the composite antenna 91. With this configuration, the crosstalk between the two circularly polarized wave antennas 1 for a satellite broadcast system can be decreased. Thus, the effect of diversity reception can be obtained. Simultaneously, the GPS antenna 82 having a different frequency band can be disposed. Thus, a small and thin composite antenna for use in a vehicle can be implemented. In this embodiment, as the circularly polarized wave antenna, the antenna 1 shown in FIG. 1 is used. However, any one of the circularly polarized wave antennas 21, 31, 41, 51, and 61 shown in FIGS. 4 through 7 and 9 through 12 may be used to implement a similar composite antenna.

What is claimed is:

1. A circularly polarized wave antenna comprising:

a quadrilateral columnar dielectric member mounted on a printed circuit board having a ground surface; and four radiation conductors provided on corresponding side surfaces of said dielectric member while tilting in predetermined directions with respect to the ground surface, wherein bottom ends of said radiation conductors are electrically connected to said printed circuit board, and mutually in-phase power is supplied between said four radiation conductors.

2. The circularly polarized wave antenna according to claim 1, wherein a through-hole extending in an axial direction is provided at a center of said dielectric member.

3. The circularly polarized wave antenna according to claim 2, wherein said through-hole is formed in a quadrilateral shape when viewed from above.

4. The circularly polarized wave antenna according to claim 2, wherein said through-hole is circular when viewed from above.

5. The circularly polarized wave antenna according to claim 2, wherein an adjusting portion is disposed in said through-hole, and a predetermined resonant frequency is set by adjusting one of a size and a mounting position of said adjusting portion.

6. A circularly polarized wave antenna according to claim 5, wherein said adjusting portion comprises a dielectric block which is inserted into said through-hole and is mounted on said printed circuit board.

7. The circularly polarized wave antenna according to claim 5, wherein said through-hole is circular when viewed from above, and a screw thread is formed on an inner wall surface of said through-hole, and said adjusting portion comprises a dielectric male screw to be screwed into the screw thread.

8. The circularly polarized wave antenna according to claim 1, wherein said dielectric member includes a columnar hole extending in an axial direction at a center of the bottom of said dielectric member and also includes an adjusting recessed portion at a center of a top of said dielectric member, and a predetermined resonant frequency is set by adjusting a depth of said adjusting recessed portion.

9. The circularly polarized wave antenna according to claim 1, wherein a plurality of through-holes extending parallel to an axial direction of said dielectric member are provided.

10. The circularly polarized wave antenna according to claim 9, wherein said plurality of through-holes are formed in a quadrilateral shape when viewed from above, and said plurality of through-holes are provided such that the through-holes are positioned symmetrically with respect to an axial line of said dielectric member, and a number of said plurality of through-holes is determined such that the through-holes are positioned symmetrically with respect to the axial line of said dielectric member.

11. The circularly polarized wave antenna according to claim 9, wherein said plurality of through-holes are circular when viewed from above, and said plurality of through-holes are provided such that the through-holes are positioned symmetrically with respect to an axial line of said dielectric member, and a number of said plurality of through-holes is determined such that the through-holes are positioned symmetrically with respect to the axial line of said dielectric member.

* * * * *